United States Patent [19]

Thygesen

[11] Patent Number: 4,491,608

[45] Date of Patent: Jan. 1, 1985

[54] METHOD FOR APPLYING A SCREED COAT TO A ROOF SURFACE

[76] Inventor: Soren Thygesen, Norrevej 79, DK-3070 Snekkersten, Denmark

[21] Appl. No.: 450,001

[22] Filed: Dec. 15, 1982

[30] Foreign Application Priority Data

Feb. 8, 1982 [DK] Denmark ..... 515/82

[51] Int. Cl.[3] ..... B05D 1/12

[52] U.S. Cl. ..... 427/186; 427/140; 427/215; 427/426; 427/427; 118/303; 118/308; 52/516; 52/714

[58] Field of Search ..... 427/186, 140, 215, 426, 427/427, 355; 118/303, 308; 52/516, 741

[56] References Cited

U.S. PATENT DOCUMENTS

| | | | |
|---|---|---|---|
| 1,973,523 | 9/1934 | Muller | 427/186 |
| 2,583,292 | 1/1952 | Bowen et al. | 427/215 X |
| 2,729,574 | 1/1956 | Schwarz | 427/186 |
| 2,732,311 | 1/1956 | Hartwright | 427/186 |
| 4,275,682 | 6/1981 | Weber | 118/303 |

FOREIGN PATENT DOCUMENTS

| | | | |
|---|---|---|---|
| 705367 | 3/1965 | Canada | 427/186 |

*Primary Examiner*—Shrive P. Beck
*Attorney, Agent, or Firm*—Watson, Cole, Grindle & Watson

[57] ABSTRACT

To build up a screed coat on a roof surface, a granular expanded inorganic material is subjected to an atomized spray of an adhesive consisting of a solution of waterglass and a hardener therefor so as to form a thin film of adhesive on each grain of the material, and the spray coated granular material thus obtained is immediately conveyed to and poured out on the roof surface. It is then spread over the roof surface and compressed to form a coherent layer constituting the screed coat. This may form a base for the superposition of insulating boards and a waterproof roof covering. The method is particulary useful in the renovation of deficient roofs originally built without a gradient towards outlets or gutters. Apparatus for carrying out the method comprises a device for causing the granular material to drop in the form of a cylindrical curtain, a rotational atomizer for spraying two component adhesive onto the surfaces of the dropping grains and a suction blower system for pneumatically conveying granular material to the spray coating station and, after treatment therein, to a pouring device on the roof.

9 Claims, 3 Drawing Figures

METHOD FOR APPLYING A SCREED COAT TO A ROOF SURFACE

BACKGROUND OF THE INVENTION

This invention relates to a method and apparatus for applying a screed coat to a roof surface.

The method according to the invention is particularly important for use in the renovation of existing flat roofs that have become deficient, and in the following description special attention will be paid to this use of the method, but as will be realized by the man skilled in the art, the method may also be used in connection with the construction of new roofs, where this may be found to be a practical and economic proposition.

Though it is an elementary rule that a roof should always be built in such a manner as to allow the rainwater to run off completely when the rain stops, this rule has nevertheless been neglected to a large extent in modern building, especially in the case of houses erected from pre-fabricated elements. In the interest of rationalization by using elements of uniform height, it became a temptation to make roofs not only flat, but level, with no gradient towards drains and gutters. The confidence in the water resistance and durability of modern roofing materials, such as high grade bitumen felt, was so great that it was thought to be reasonable to disregard the normal requirement that there be a gradient sufficient to permit rainwater to run off completely without fail. This practice was even accepted by the building authorities.

However, experience has shown that such gradientless roofs are extremely apt to deteriorate, often after a relatively short period of time, and that this may have disastrous consequences for the whole of the building. After some time the roof supporting structure is apt to subside, whereby cavities are formed in the surface of the roof. The water cannot run off from these cavities, and in certain climates these roofs are more or less under water all the year round. The roof covering will tend to crack in these cavities, whereby the water will leak into the roof supporting structure, which then begins to decompose. Wooden structures are attacked by rot and dry rot, steel structures by rust, and insulating materials loose their insulating power.

There exists therefore an imminent need for methods and means for renovating such roofs before deterioration has started, or at least before it has proceeded so far that complete re-building is required.

SUMMARY OF THE INVENTION

It is an object of the invention to provide a method that may be used for applying to deficient roofs of the type described a screed coat which at the same time fills the cavities and, when correctly applied, forms a layer which has a gradient from all areas of the roof surface towards drains and gutters. Such a layer may serve as a base for the superposition of insulation boards and a new waterproof roof covering.

The material used for building up the screed coat in carrying out the method according to the invention consists of a mixture of an expanded inorganic material of low specific gravity and an adhesive consisting of waterglass and a hardener therefor. Important examples of expanded inorganic materials are those referred to as vermiculite, which is an "exfoliated" mica product, and perlite, which is a product of volcanic origin.

Materials of the type described are known per se.

It has been found, however, that special conditions have to be observed both in the production and in the further handling of such materials in order to make them useful for building up a screed coat on a roof surface.

Based on these premises, the method according to the invention comprises the steps of subjecting a granular expanded inorganic material to an atomized spray of an adhesive consisting of a solution of waterglass and a hardener therefor in such a manner as to form a film coating of the adhesive on the surface of each grain without affecting the granular nature of the material, causing the spray-coated granular material immediately after it has been thus produced and without any intervening mechanical working or compression to be poured out on the roof surface, spreading it over that surface, and compressing and smoothing it to form a coherent layer of a geometrical surface configuration showing a gradient from all points of the surface towards rainwater outlets.

By proceeding in this manner the advantage is obtained that the material remains in its free granular state until it is poured out on the roof and is only thereafter compressed to make the spray coated grains stick together to form a coherent layer. In this manner the grains are efficiently protected against collapsing so that the screed coat will have a very low density, e.g., on the order of 150 kg/m$^3$ after compression and hardening. This is particularly important in the case of renovating deficient roofs of the type previously described because such roofs are frequently constructed with very light supporting structures, such supporting structures not being originally designed for carrying any substantial load beyond possibly a snow load and the load arising from foot traffic in connection with cleaning and maintenance of the roof. The screed coat is incombustible because it does not contain any organic materials, and for the same reason it is unassailable to rot and dry rot. It has a high degree of water resistance so that it will not suffer damage if some water gets access to it by accident. It is also to be mentioned that the components of which the screed coat is made are not harmful to the environment.

The components of the material can be so selected that hardening proceeds very fast, so that subsequent steps of the full re-roofing process can be commenced very soon after the screed coat has been applied. The compressional strength is fully satisfactory when the screed has been covered with insulating boards or the like, which distribute the pressure created, e.g., by foot traffic on the roof.

DESCRIPTION OF THE PREFERRED EMBODIMENT

Figure 1:
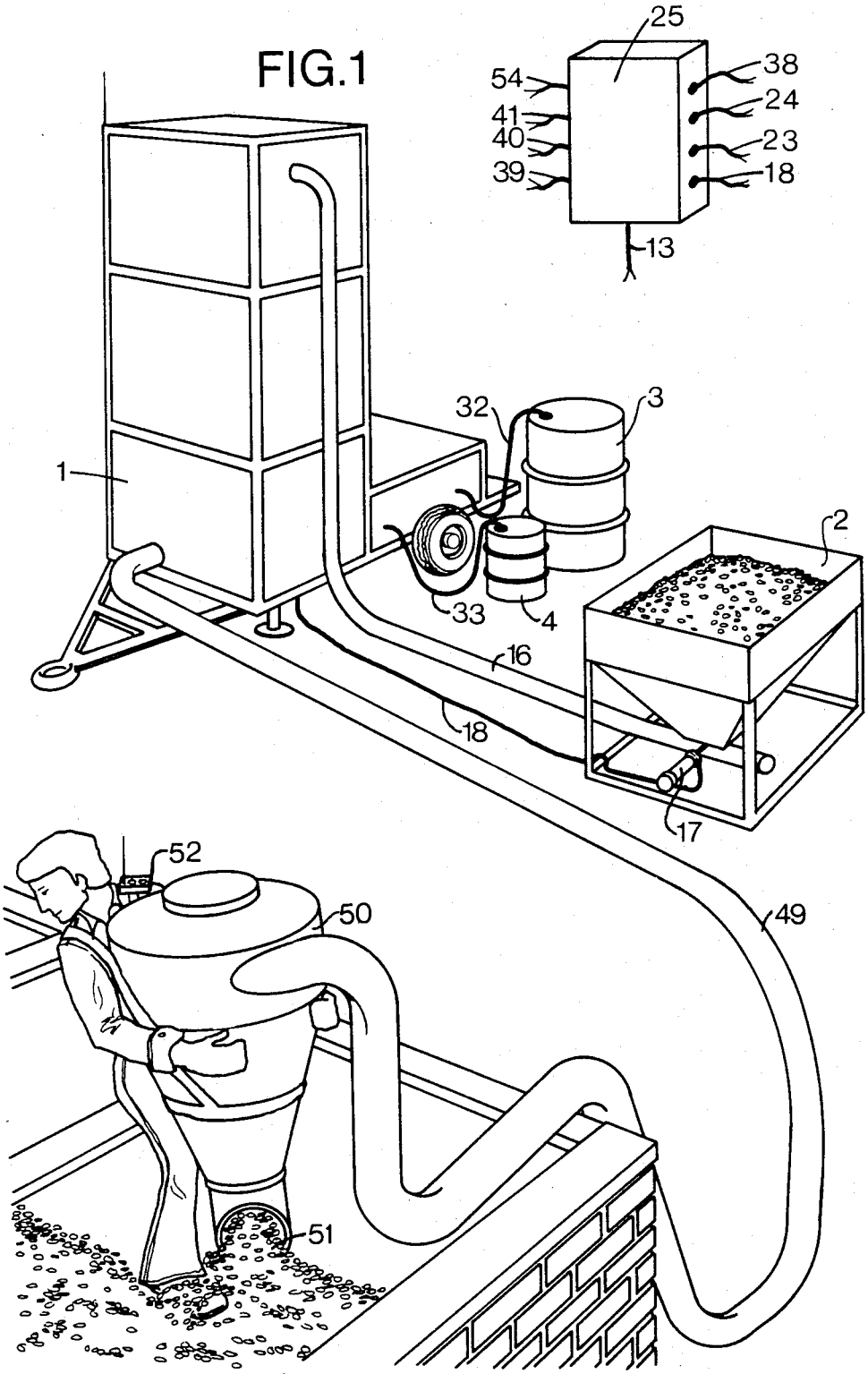
FIG. 1 is an overall diagrammatic view of a complete mobile plant for carrying out the method according to the invention.
Figure 2:
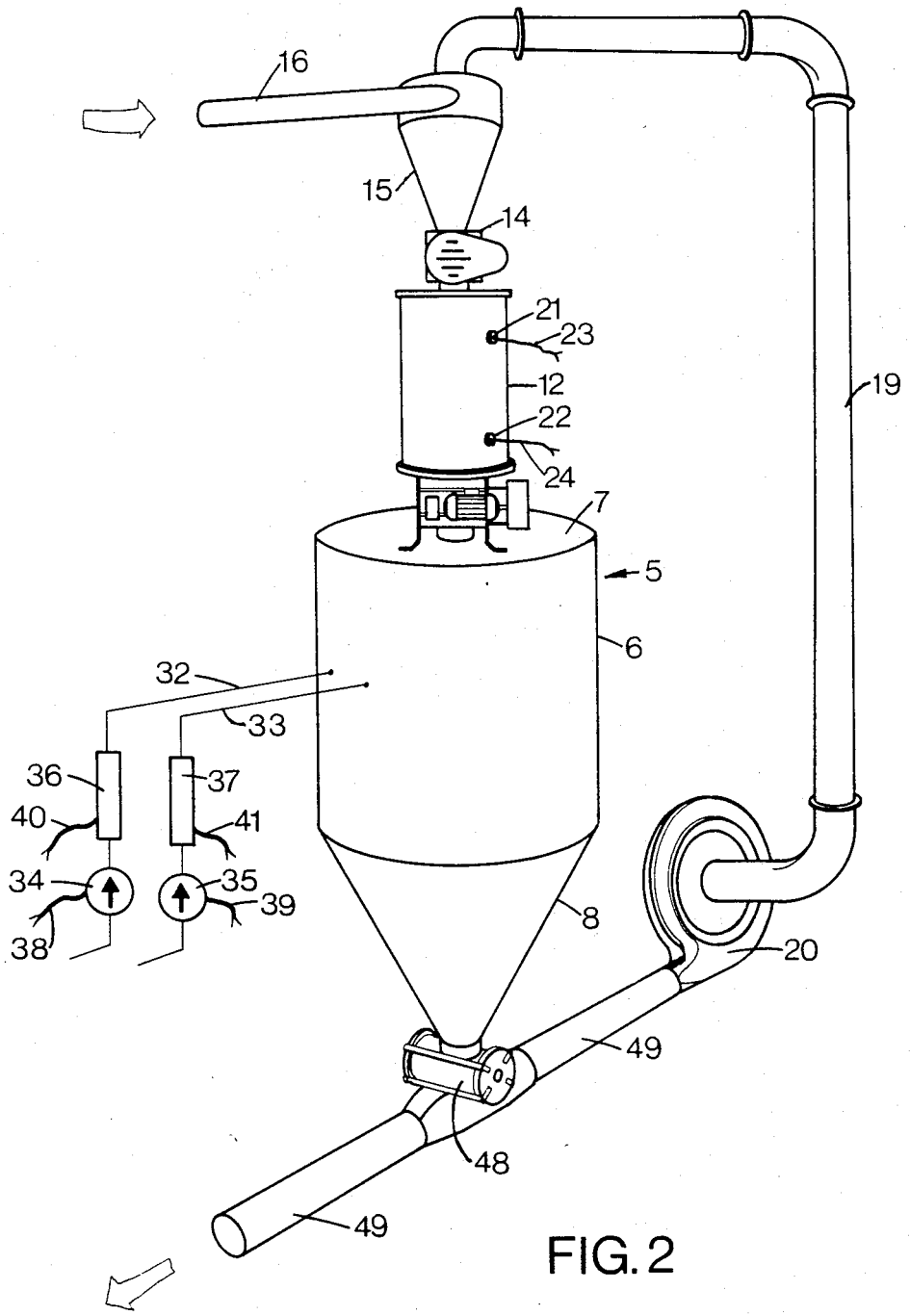
FIG. 2 is a diagrammatical perspective view of the main components of the plant and associated piping.
Figure 3:
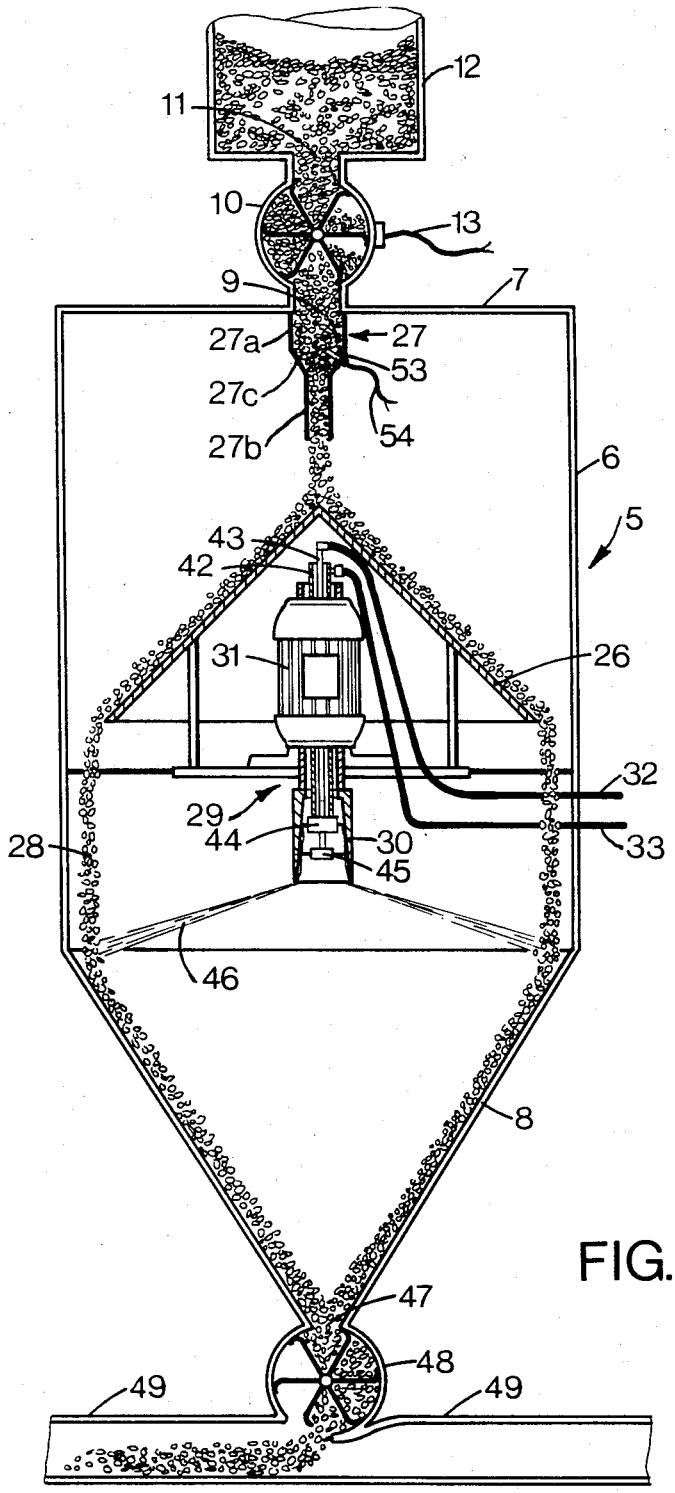
FIG. 3 is a vertical section through a spray coating apparatus of the plant, and parts directly associated therewith.

Raw materials suitable for carrying out the method according to the invention are:

(1) An expanded mineral granulate having a grain size of 0.5–6 mm and a bulk specific gravity of 50–100 kg/m$^3$, e.g., perlite or vermiculite.

(2) A saturated aqueous solution of sodium silicate (sodium waterglass) having an $SiO_2/Na_2O$ ratio $\geqq 3.0$, a density of approximately 1400 kg/m$^3$ and a dry substance content of 30–40%.

(3) The organic ester triacetin, which is a liquid having a density of 1170 kg/m$^3$.

Raw material (1) may advantageously be used in the form of a hydrophobized product. Hydrophobization is a process by which an expanded mineral granulate, while still hot from the expansion process, is sprayed with a hydrophobizing agent to make the granulate hydrophobic, i.e., water repellent. Hydrophobizing agents are available on the market. Examples are the products marketed by Hoechst Aktiengesellschaft under the product names Hoe 3187 and Hoe 2745. Expanded mineral granular material treated by such hydrophobizing agents are also available on the market from the producers of expanded perlite, vermiculite and similar materials. It has been found that the use of a hydrophobized mineral raw material does not give rise to any problems in carrying out the spray coating or other steps of the method according to the invention, nor does it detract from the adhesive power of the adhesive, and that the water repellence created by the hydrophobization of the mineral raw material remains in the finished screed coat, so that this is protected against absorption of water that may unintentionally get access to it. While such absorbed water would not destroy the screed coat as such, it is clearly an advantage to avoid it.

The proportion of granulate/waterglass/hardener may be approximately 16/10/1 by weight, corresponding to approximately 250/8/1 by volume. Good results have been obtained with a composition containing 55–65% by weight of exfoliated mica, 30–42% by weight of waterglass solution and 3–5% by weight of hardener.

When the waterglass and the ester are mixed in the proportion 10:1, they constitute a light-fluid adhesive, the ester undergoes a hydrolysis by taking up part of the water chemically bound in the waterglass, thereby liberating a volatile alcohol and a weak acid. The hydrolysis is completed in ½–1 hour whereby the adhesive has become solidified.

The alcohol evaporates and diffuses out of the screed coat in the course of the setting time. The weak acid is neutralized by the mineral granulate.

The machine components of the mobile plant illustrated in the drawings are mounted in a housing 1 constructed as a trailer which can be transported from one working site to another by means of a motor car, e.g., a passenger car, to be left standing on the ground in the close vicinity of a building on the roof of which a screed coat is to be built up. Placed on the ground are also a silo 2 for the supply of granulate and drums 3 and 4 for the supply of waterglass solution and hardener respectively. An operator on the ground has the job of controlling and surveying the machinery and of replenishing the supplies of raw material. For the latter purpose he should dispose of a small tractor with a fork elevator for the transportation of pallets with granulate, which is normally delivered in bags, and drums with waterglass and hardener.

The personnel on the roof comprises two or three men, or, depending on the size and nature of the roofing job, even more e.g., four or five. These should be skilled workers having routine familiarity in the setting up of guide bars and the laying and smoothing of plaster and concrete layers to form wry surfaces so as to provide a gradient towards an outlet (such as floors in wet premises, e.g., slaughter-houses).

The machinery mounted in the trailer comprises a spray-coating apparatus 5 housed in a container which has an upper cylindrical portion 6, closed by a top wall 7, and a lower conical portion 8. A central opening 9 in the top wall 7 is connected through a cell feeder 10 to a bottom opening 11 of a cylindrical buffer silo 12 mounted above the spray coating container. The cell feeder 10 is similar to the cell sluices normally used in suction blower conveying systems, and thus consists of a cylindrical housing in which there is mounted a rotor carrying a number of radial vanes sliding along the cylindrical wall of the housing to form cells serving to sluice material from one environment to another. The cell feeder 10 may be constructed as an ordinary cell sluice, but since there is no difference of air pressure between its inlet and outlet, the requirement of sealing effect is lower. The cell feeder 10 is driven by an electric motor, not shown, which is fed through a conductor 13.

At its top the buffer silo is connected through an ordinary cell sluice 14 to the bottom of a cyclone separator 15, forming part of a suction blower conveying system. To the tangential inlet of the cyclone separator 15 is connected piping 16 extending to and below the bottom of the silo 2 and thereafter opening into the atmosphere. A bottom opening of the silo 2 is connected to the interior of the piping 16 through a sliding gate that can be opened and closed by means of an electric or pneumatic actuator 17 controlled by a conductor 18. The top outlet of the cyclone separator 15 is connected through piping 19 to the suction inlet of the suction blower 20 of the conveying system. The pipings 16 and 19, and further piping to be mentioned below, are built up from pipe elements, bends, etc., assembled by means of quick release clamps in the manner usual in suction blower systems so that they can easily be adapted to the circumstances in each individual case.

It will be realized that when the bottom gate of the silo 2 is opened by means of the actuator 17, granular material will be conveyed by the suction blower system to the cyclone separator 15 and will be sluiced from the bottom of the latter through the cell sluice 14 into the buffer silo 12. To control this supply, the buffer silo is provided with two capacitive sensors 21 and 22 connected through conductors 23 and 24 to a preferably computerized control box mounted in a convenient position on the trailer and diagrammatically represented at 25 in FIG. 1. This is a central unit to which all control conductors, thus also the previously mentioned conductors 13 and 18, are connected. The arrangement is such that the actuator 17 is caused to close the bottom gate of the silo 2 when the level of granular material rises to the level of the upper sensor 21, and to open the gate when the level of granular material falls to the level of the lower sensor 22. The time of fall from the upper to the lower level provides an indication from which the control box can determine the rate at which granular material is consumed by the spray coating apparatus 5.

In the cylindrical portion 6 of the housing of the spray coating apparatus there is mounted a stationary spreader 26 shaped as an inverted cone. The tip of the spreader is located directly below a spout 27 connected to the central opening 9 of the top wall 7. The spout 27 has an upper wider portion 27*a* and a lower narrower portion 27*b* connected through a funnel portion 27*c*. When the cell feeder 10 is running fast enough to keep the spout 27 constantly filled with granular material, the rate at which the material drops from the spout onto the tip of the spreader 26 will be determined mainly by dimensions of the narrow portion 27*b* of the spout. Therefore, the spray coating apparatus can be calibrated for a certain job by selecting a suitable spout.

The granular material dropping onto the spreader 26 slides and/or rolls down its conical surface and leaves its lower edge in the form of a cylindrical curtain 28 of freely falling grains.

Below the spreader there is mounted a rotational atomizer 29 of a type well known per se. The atomizer consists mainly of an inverted cup, which is rotated at high speed, e.g. 5,000–6,000 r.p.m., by means of an electrical motor 31 having a hollow shaft. Waterglass and hardener are supplied from the drums 3 and 4 to the atomizer through hoses 32 and 33 with built-in mono-pumps 34 and 35 and flow meters 36 and 37. Conductors 38 and 39 for controlling the mono-pumps and signal conductors 40 and 41 from the flow meters 36 and 37 are connected to the control box 25. In the atomizer the two liquids are conducted through stationary concentric tubes 42 and 43 extending through the hollow shaft of the motor 31, and to separate spray heads 44 and 45, from which they are sprayed towards the inner wall of the inverted cup 30 to form films of liquid flowing down the inner wall and beginning to mix where the hardener liquid sprayed from the upper spray head 44 reaches the film of waterglass solution sprayed from the lower spray head 45. At the lower edge of the cup 30 the mixture of the two liquids is atomized to form a mist 46 which impinges and penetrates into the curtain 28 of freely falling grains, whereby each grain is spray coated with a thin film consisting of a mixture of the two liquids. In this phase the liquid film is very little sticky so that the spray coated material will remain in granular form. The spray coated grains now roll down the inner face of the conical wall 8, and at the same time liquid remains that may not have been caught by the particles trickle down the same inner face, which is coated with Teflon in order efficiently to prevent particles and liquid from sticking to it. During this travel the liquid will be even more uniformly distributed over the surfaces of all grains by the gentle rubbing of the grains against each other and against any remains of liquid trickling down the wall. Surface tension effect will also assist in uniformly distributing the liquid over the surfaces of the grains. At a bottom opening 47 of the conical wall 8 the spray-coated granular material is caught by a cell sluice 48 and sluiced into piping 49 extending from the pressure side of the suction blower 20 and extending further to the tangential inlet of a cyclone separator 50 on the roof on which a screed coat is to be laid. The cell sluice 48, the piping 49 therefrom to the cyclone separator 50, and the cyclone separator itself are interiorly coated with Teflon. Part of the piping 49 leading to the cyclone separator 50 is in the form of one or more hoses, so that the cyclone separator 50 will be freely movable from spot to spot on the roof. It may be carried by a man in a sling, or it may be supported on the roof on a barrow frame or the like. The cyclone separator 50 is provided at its bottom with a laterally directed opening 51 for pouring out the spray-coated granular material. The team on the roof immediately spreads the poured out material, lightly compresses it, such as by beating or stroking it with a shovel or a float, and smoothes it with a straight-edge or screed board following guide bars that have beforehand been laid with the correct gradient towards the roof outlet. When an area of the screed has been finished, the guide bars may be removed and remounted for use in the finishing of the next successive area to be covered.

In the condition in which the material is poured out on the roof, fresh from the spray-coating process, it is excellently workable for laying and shaping. Any compression before laying would detract from the workability and tend to make the material lumpy. By contrast, the pneumatic transportation of the freshly spray-coated material rather has the effect of maintaining or improving the free granular nature of the material.

Another important consideration is that only a rather limited time is available for spreading, compressing and smoothing the material on the roof. After the spray coating has been performed, the hardending of the adhesive at first progresses very slowly, but after a certain time interval the degree of hardening suddenly rises very steeply to a high percentage, and then again flats out asymptotically towards full hardening. After the noted time interval the material is no longer workable, and compression will not make the grains stick together. When the above-mentioned raw materials (1)–(3) are used, the $SiO_2/Na_2O$ ratio is being $=3.0$, the noted time interval is about 20–25 minutes, and a few minutes after the layer will be stiff enough to support the load of a cover board and of foot traffic on that board.

From the above explanation it will be understood that it is important that the production and delivery of spray-coated granular material should be adapted to the progress of the laying procedure on the roof, so that the material will never heap up, but will always be available in a sufficient quantity, allowance being made for periods of slow progress and for intermissions. It will now be explained how this is achieved in the disclosed embodiment of the invention.

During working hours, the suction blower system is constantly running, and this also includes the cell sluices 14 and 48 and the atomizer 29. When spray-coated material is being produced and delivered on the roof, the cell feeder 10 runs at a predetermined speed sufficient to keep the spout 27 filled with fresh granular material. The rate at which this material is fed to the atomizing device is calculated by the computer of the control box from the signals of the capacitive sensors 21 and 22, as previously explained, and from the value of this rate the computer calculates the correct rates of supply of waterglass and hardener to obtain the predetermined proportions of all three components in the screed material. By means of the signals received from the flow meters 36 and 37, the computer controls the speeds of the mono-pumps 34 and 35 to obtain the calculated rates of supply.

When the production and delivery of spray-coated granular material is to be stopped for an interval of time, the cell feeder 10 is stopped by a signal from the control box. This signal is preferably released by an operator on the roof. For example the man handling the cyclone separator 50 may be equipped with a signal transmitter 52 by means of which he can transmit stop and start signals to the control box 25 by pressing corresponding buttons. When the cell feeder 10 is stopped, the granular material present in the spout 27 and the cell or cells in position immediately above same will drop out of the spout and onto the spreader 26 at the same speed as before, and during the short time when there is still granular material present in the spout above the level of a capacitive sensor 53 provided at the conical portion 27c of the spout, the mono-pumps 34 and 35 will continue to run, but at the moment the last grains pass the level of the capacitive sensor 53 a signal is transmitted through a conductor 54 to the control box 25 which again transmits stop signals to the mono-pumps 34 and 35. Thereby the supply of all three components to the spray coating apparatus 5 is stopped in such a manner that at least practically all grains will be regularly spray coated and there will be no surplus waterglass and hardener present in the atomizer or impinging the inner wall of the spray coating apparatus. This apparatus will soon be completely emptied by the cell sluice 48, and all the material fed into the piping 49 will be blown to the cyclone separator 50 and poured out on the roof so that the machinery in its entirety is clean and ready for resuming production and delivery when a start signal is again released. When this occurs, the cell feeder 10 is first started and the mono-pumps 34 and 35 are started after the first grains have passed the level of the capacitive sensor 53.

After the screed coat has been laid, it is covered by insulating boards or other cover boards, where no additional insulation is required. These may be placed on the screed coat a few minutes after this has been laid and compressed.

The optimum ratio of compression has been found to be approximately 3:2, and the skilled workers very quickly learn to feel, in their handling of the material, when the proper degree of compression has been reached. With this degree of compression, the density of the layer upon completion of the hardening will be about 150 kg/m$^3$, and its compressive strength for distributed pressure will be above 800 kg/m$^2$.

After the insulating boards have been placed on the screed coat, they are attached to the roof supporting structure by means of screws having an insulating shaft in order not to form cold bridges from the surface of the roof to the roof supporting structure. The placing and fixing of the insulating boards may be performed concurrently with the further progress of the laying of the screed, so that the team on the roof may take care of both jobs in a continuous procedure.

As a final step in the roofing procedure, the insulating boards are covered with waterproof sheet material in well known manner.

I claim:

1. A method of applying a screed coat to a roof surface, comprising the steps of subjecting a granular expanded inorganic material to an atomized spray of an adhesive consisting of a solution of waterglass and a hardener therefor in such a manner as to form a film coating of said adhesive on the surface of each grain without affecting the granular nature of the material, causing the spray coated granular material, immediately after it has been thus produced and without any intervening mechanical working or compression, to be poured out on the roof surface, spreading it over that surface and compressing and smoothing it to form a coherent layer of a geometrical surface configuration showing a gradient from all points of the surface towards rainwater outlets.

2. A method as in claim 1, in which said granular expanded inorganic material is used in hydrophobized form.

3. A method as in claim 1, in which the particles of the inorganic material are caused to drop freely through a cloud produced by atomization of the waterglass and the hardener.

4. A method as in claim 1, in which the grains of expanded inorganic material are caused to drop freely in the form of a substantially cylindrical curtain, and the mixture of waterglass solution and hardener therefor is atomized in the inner space confined by said curtain of dropping grains by means of a rotational atomizer so as to be sprayed towards and into said curtain to coat each of its grains with a film of two component adhesive.

5. A method as in claim 4, in which the spray coating process is performed in a spray coating container to which the granular material is supplied at the top, and from the bottom of which the spray coated granular material is conveyed through a pneumatic piping to a movable pouring device on top of the roof.

6. A method as in claim 5, in which the suction side of a suction blower system is used for conveying the fresh granular material from a storage container to the top of the atomizing container, and the pressure side of the same suction blower system is used for conveying the spray coated granular material from the bottom of the atomizing container to the pouring device on the roof, the atomizing container being connected between the suction and pressure sides of the suction blower system through cell sluices.

7. A method as in claim 1, in which a waterglass solution having a dry substance content of 30–40% is used.

8. A method as in claim 1, characterized by using as waterglass solution a saturated aqueous solution of sodium silicate with $SiO_2/Na_2O$-ratio $\geqq 3.0$ and specific gravity approximately 1.4, and using as hardener the organic ester triacetin.

9. A method as in claim 1, using 55–65% by weight of exfoliated mica, 30–42% by weight of waterglass solution and 3–5% by weight of hardener.

* * * * *